US005095699A

United States Patent [19]

Blackshear

[11] Patent Number: 5,095,699

[45] Date of Patent: Mar. 17, 1992

[54] STIRLING TYPE CYLINDER FORCE AMPLIFIER

[75] Inventor: Edmund D. Blackshear, Wappingers Falls, N.Y.

[73] Assignee: International Business Machines Corporation, Armonk, N.Y.

[21] Appl. No.: 694,743

[22] Filed: May 2, 1991

[51] Int. Cl.[5] ..... F02G 1/043

[52] U.S. Cl. ..... 60/516; 60/517; 60/508

[58] Field of Search ..... 60/508, 512, 516, 517

[56] References Cited

U.S. PATENT DOCUMENTS

| | | | |
|---|---|---|---|
| Re. 29,518 | 1/1978 | Franklin | 60/520 |
| Re. 30,176 | 12/1979 | Beale | 60/520 |
| 3,232,045 | 3/1964 | Fokker | 60/24 |
| 4,050,250 | 9/1977 | Danis | 60/517 |
| 4,172,363 | 10/1979 | Bex | 60/517 |
| 4,183,214 | 1/1980 | Beale et al. | 60/520 |
| 4,253,303 | 3/1981 | Liljequist | 60/517 |
| 4,413,475 | 11/1983 | Moscrip | 60/521 |
| 4,429,530 | 2/1984 | Beale | 60/517 |
| 4,442,670 | 4/1984 | Goldman | 60/517 |
| 4,619,112 | 10/1986 | Colgate | 62/6 |

FOREIGN PATENT DOCUMENTS

| | | |
|---|---|---|
| 3229108A1 | 8/1982 | Fed. Rep. of Germany . |
| 3315493A1 | 4/1983 | Fed. Rep. of Germany . |

*Primary Examiner*—Allen M. Ostrager
*Attorney, Agent, or Firm*—Charles W. Peterson, Jr.

[57] ABSTRACT

A mechanical force amplifier is disclosed including a gas-containing cylinder having one fixed end and one movable end determined by the position of an output power piston. A cold temperature zone and a hot temperature zone are maintained along the axis of the cylinder, the cold zone being adjacent the fixed end and the hot zone being adjacent the movable end. The power piston is resiliently urged toward the fixed end so as to compress the gas.

A displacement piston is positionable along the axis of the cylinder within the cold zone and the hot zone and is designed to allow the gas to flow around it as the piston is moved. The displacement piston and the power piston are completely uncoupled from movement with each other except through the gas.

4 Claims, 2 Drawing Sheets

STIRLING TYPE CYLINDER FORCE AMPLIFIER

BACKGROUND OF THE INVENTION

The present invention generally relates to mechanical force amplifying devices and, more particularly, to one using thermal energy from a source external to a gas-containing cylinder having two independently movable pistons for amplifying an input force applied to one of the pistons.

In the automation and robotic arts, for example, there often is a need for devices providing substantial mechanical force outputs in response to relatively small electrical or mechanical controlling inputs. High power solenoids and pneumatic pistons have been used to meet such needs. Such solenoids, however, tend to be massive and expensive and require high electrical currents. Pneumatic pistons have the drawback of necessitating control pumps and plumbing. Thus, there is a need for a relatively lightweight, inexpensive and plumbing-free mechanical force amplifier.

SUMMARY OF THE INVENTION

Accordingly, it is an object of the present invention to provide a mechanical force amplifying device for converting a low force single stroke input to a high force single stroke output.

Another object is to provide a mechanical amplifying device utilizing thermal energy to convert a low force input to a high force output.

These and other objects, as will appear from a reading of the following specification, are achieved in a preferred embodiment of the invention by the provision of a gas-containing cylinder having one-fixed end and one movable end, the latter being determined by the position of an output power piston. The power piston is resiliently urged toward the aforesaid fixed end so as to compress the gas. A cold temperature zone and a hot temperature zone are maintained along the axis of the cylinder, the cold zone being adjacent the fixed end and the hot zone being adjacent the movable end. A displacement piston is positionable along the axis of the cylinder either within the cold zone or the hot zone to confine the gas either to the hot zone or to the cold zone, respectively, depending upon the axial position of that piston. The displacement piston is designed to allow the gas to flow around it as the piston is moved from one position to the other.

When a low force input moves the displacement piston from the hot zone to the cold zone, the gas is forced from the cold zone to the hot zone, in opposite fashion. The ensuing expansion of the now heated gas actuates the power piston axially outward with a driving force determined by the initial (cold) pressure of the gas and the temperature difference between the cold and hot zones. When the displacement piston is returned to the hot zone, thereby forcing the gas back to the cold zone, the power piston is returned to its deactuated position by spring force acting against the reduced pressure of the now cooled gas. Provision also can be made for optional partial movement of the displacement piston.

BEST MODE FOR CARRYING OUT THE INVENTION

Figure 1:
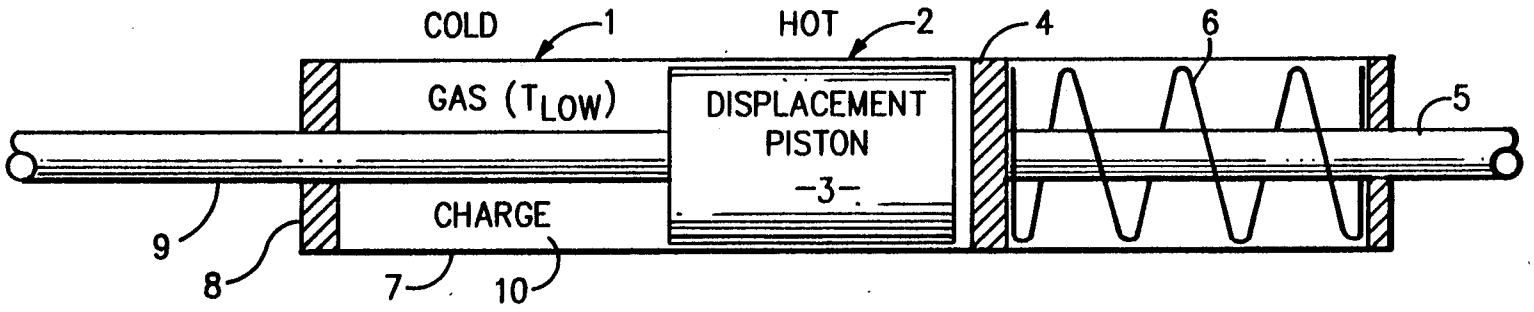
FIG. 1 and FIG. 2 are simplified cross-sectional sketches showing the operating principals of the resetting mode and of the amplifying mode, respectively, of the force amplifier of the present invention.

The present invention exploits some of the structure of the well-known Stirling external combustion engine in combination with new input and output connection means to achieve an entirely different utilitarian purpose which is the production of a relatively strong single stroke mechanical output from the amplification of a relatively weak single-stroke mechanical input.

As set forth in U.S. Pat. No. 4,253,303 to Jon L. Liljequist, issued on Mar. 3, 1981, an external combustion Sterling engine comprises six basic parts, i.e., a cylinder, a power piston, a displacer piston, a crackshaft and two connecting rods for connecting respective pistons to the crackshaft in classical engine fashion whereby all parts become actuated in unified cyclical movement. The Stirling engine was invented over one hundred fifty years ago and has been studied since as a hopefully advantageous replacement for the widely used internal combustion engine.

In accordance with the present invention, it has been found that by permanently decoupling the output of the power piston from the input to the displacement piston of a Sterling-type engine and by connecting a source of relatively weak single stroke input signal to the displacement piston, a relatively strong single stroke output signal is provided by the power piston. This action will be better understood by reference to FIGS. 1 and 2. Gas-containing cylinder 7 of FIG. 1 possesses a fixed end 8 and a movable end provided by power piston 4. Power piston 4 is connected to apply the amplified output signal to a load (not shown) and is resiliently urged by spring 6 toward fixed end 8. Piston 4 is capable of travel along the axis of cylinder 7 within hot zone 2 and is sealed by low friction rings against the cylinder walls.

Displacement piston 3 is driven by a low force, single stroke input applied via shaft 9 which slidably penetrates through fixed end 8 in sealed fashion. Piston 3 is commensurate in length with the cold zone and is capable of travel into either cold zone 1 or hot zone 2 and functions to shuttle gas 10 from hot zone 2 to cold zone 1 and vice-versa, depending upon its position as determined by the input applied to shaft 9. The gas 10 freely flows around piston 3 as it is thrust forward or withdrawn along its axial travel within cylinder 7.

Figure 2:
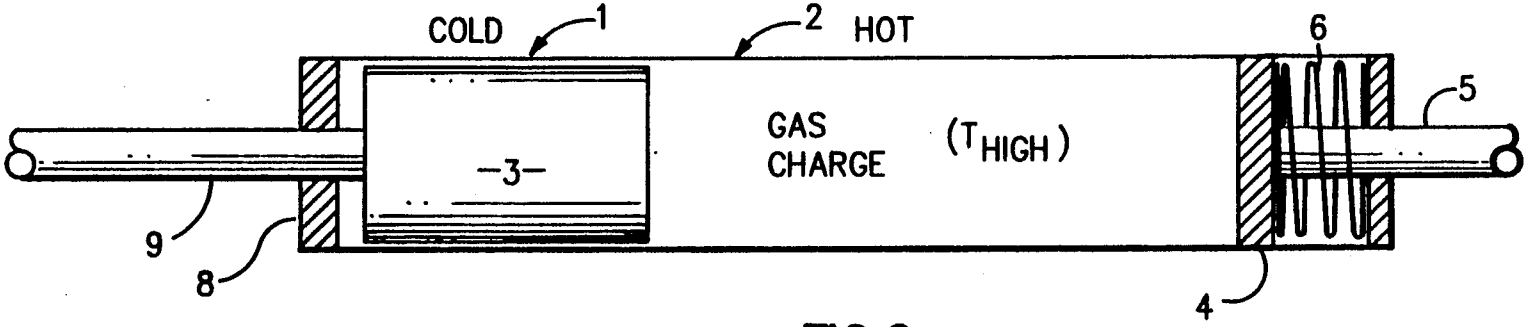

When shaft 9 is in the deactuated position shown in FIG. 1, gas 10 resides in cold zone 1 in a minimum pressure condition and displacement piston 3 resides in hot zone 2. As shaft 9 is withdrawn (by the input force to be amplified) toward the actuated position shown in FIG. 2, gas 10 is displaced by piston 3 from cold zone 1 and is diverted to hot zone 2. Gas 10 becomes heated to a high pressure condition and forces piston 4 against spring 6 to the position shown in FIG. 2. The gas 10 is introduced initially into chamber 7 of FIG. 1 with a pressure which will provide the required output force on shaft 5 of FIG. 2 for a given temperature difference between hot zone 2 and cold zone 1. The apparatus is restored to its deactuated condition and made ready to receive a second input simply by moving piston 3 from its position in FIG. 2 to its position in FIG. 1.

It should be noted that the apparatus as described above is a force amplifier in a broad sense but is of a kind similar in action to that of an electrical flip-flop circuit, i.e., the output signal is much greater than the input signal but does not bar a proportional relationship to the input signal if the amplitude of the input signal is varied, assuming that the amount of the total displacement of shaft 9 (from FIG. 1 to FIG. 2) is not varied. However, if the input signal is designed to be the amount of displacement of shaft 9 (rather than the force with which shaft 9 is moved), then the amount of output force available on shaft 5 can be varied. This follows from the fact that the temperature difference applied to the gas 10 becomes a function of how far piston 3 is displaced into cold zone 1 when it is in its actuated position.

Figure 3:
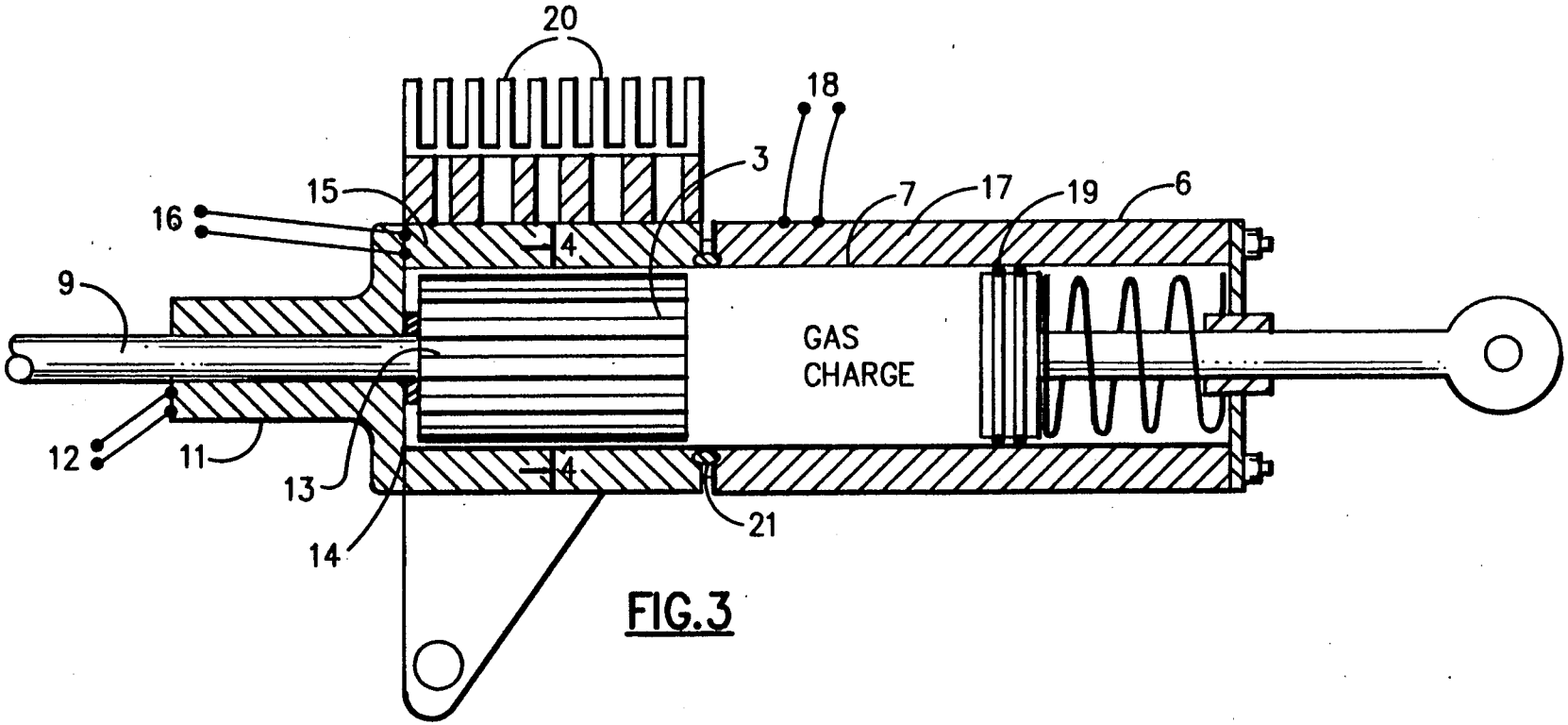
FIG. 3 is a cross-sectional view of a preferred embodiment of the present invention when it is operating in the amplifying mode corresponding to FIG. 2.
Figure 4:
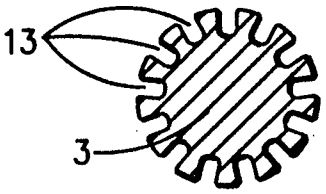
FIG. 4 is an end view of displacement piston 3 of FIG. 3.

FIGS. 3 and 4 clarify the construction details of a preferred embodiment of the present invention. An input solenoid 11 is mounted about shaft 9 and moves shaft 9 and piston 3 into the position shown in response to an electrical signal applied to solenoid terminals 12. When deactivated, solenoid 11 returns shaft 9 and piston 3 into a position corresponding to FIG. 1. Piston 3 made of a thermally conductive material such as aluminum and is equipped with external grooves 13 as shown in FIG. 4. Grooves 13 are sized to maximize heat transfer and to minimize resistance to the flow of gas as piston 3 is moved through gas 10 between its actuated and deactuated positions. Guide block 14 is provided to align piston 3 within cylinder 7. Block 14 is made of the same shape and slightly larger than piston 3 using a wear resistant organic material such as teflon. Thermoelectric cooler 15 with waste heat sink 20 surrounds the cold zone of cylinder 7 and is energized via terminals 16. Correspondingly, resistive heaters surround hot zone 2 and are energized via terminals 18. Piston 4 is sealed by low friction rings 19 of organic material such as teflon. Thermal barrier and seal 21 is interposed the cold and hot zone walls of cylinder 7.

What is claimed is:

1. A force amplifier for converting a given single stroke input force to a higher single stroke output force said amplifier comprising:

a cylinder having one fixed end and one movable end;

a gas charge in said cylinder;

a first axial portion of said cylinder contiguous to said fixed end defining a cold zone;

a second axial portion of said cylinder contiguous to said cold zone defining a hot zone;

cooling means adjacent said first portion;

heating means adjacent said second portion;

a first piston mounted in said cylinder for axial travel through said cold zone and said hot zone, said first piston having an axial length commensurate with said cold zone and permitting the flow of gas through said first piston as said first piston is moved between said cold zone and said hot zone;

a second piston mounted in said cylinder for axial travel through only said hot zone, said second piston being completely uncoupled from movement with said first piston except through said gas, said second piston being slidably sealed to said cylinder and constituting said movable end of said cylinder, and resilient means for urging said second piston toward said first piston; and a source of said single stroke input force coupled to said first piston;

said single stroke output-force being provided by said second piston.

2. The amplifier defined in claim 1 wherein said first piston is moved by said input force to fully reside in either said cold zone or said hot zone.

3. The amplifier defined in claim 1 wherein said first piston is moved by said input force to partially occupy said cold zone and said hot zone.

4. The amplifier defined in claim 2 wherein said source is a solenoid actuator driven by an electrical input signal.

* * * * *